United States Patent [19]

Peoples

[11] Patent Number: 4,876,805

[45] Date of Patent: Oct. 31, 1989

[54] SHOCK ABSORBING DEVICE FOR HIGH HEEL FOOTWEAR

[75] Inventor: William J. Peoples, Allentown, Pa.

[73] Assignee: Polymer Dynamics Technology, Inc., Allentown, Pa.

[21] Appl. No.: 188,907

[22] Filed: Apr. 29, 1988

[51] Int. Cl.[4] ..... A43B 13/40; A43B 13/28; A43B 21/32

[52] U.S. Cl. ..... 36/43; 36/24.5; 36/37; 36/44

[58] Field of Search ..... 36/43, 44, 76 C, 24.5, 36/34 A, 37, 35 R; 12/142 J, 147 A

[56] References Cited

U.S. PATENT DOCUMENTS

| | | | |
|---|---|---|---|
| 1,995,831 | 3/1935 | Baynard | 36/37 |
| 2,083,581 | 6/1937 | Silver | 36/37 X |
| 2,175,687 | 10/1939 | Everston | 36/37 |
| 3,593,437 | 7/1971 | Kogert | 36/34 A |
| 4,541,186 | 9/1985 | Mulvihill | 36/44 X |
| 4,627,178 | 12/1986 | Sullivan et al. | 36/44 |

FOREIGN PATENT DOCUMENTS

| | | | |
|---|---|---|---|
| 3105422 | 9/1982 | Fed. Rep. of Germany | 36/34 A |
| 11532 | of 1909 | United Kingdom | 36/37 |

*Primary Examiner*—James Kee Chi

*Attorney, Agent, or Firm*—Richard O. Church

[57] ABSTRACT

An insole for high heel footwear is designed to provide comfort and support cushioning and significantly reduce shock and vibration through the skeletal system. The insole is comprised of a relatively thin layer of open cell, flexible, resilient foam of low compression set, a heel bucket which extends into the heel of the shoe or an implant which is posiitoned at the heel and a metatarsal insert. The heel bucket or implant, and the metatarsal insert are formed from a shock absorbing, viscoelastic polyurethane elastomer to moderate the accleration of heel and metatarsal strike generated shock waves.

11 Claims, 3 Drawing Sheets

Fig. 5
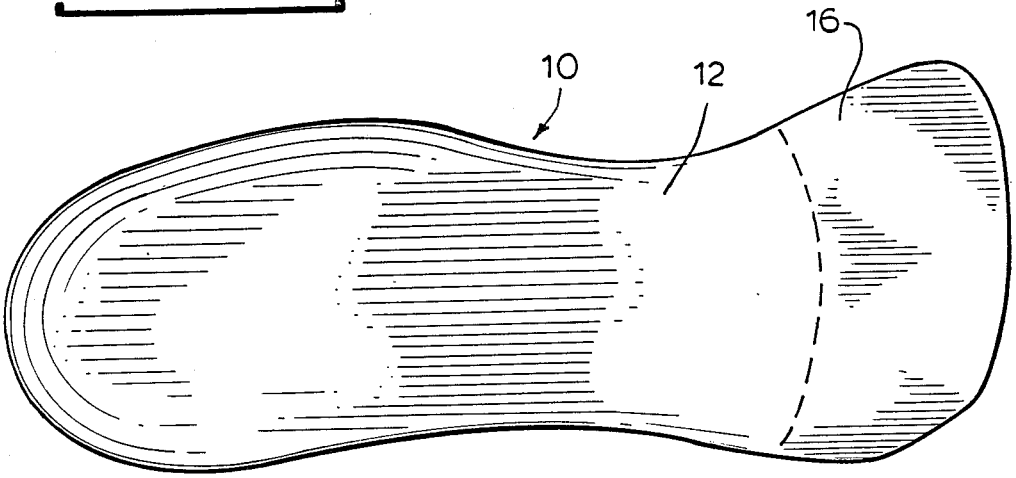
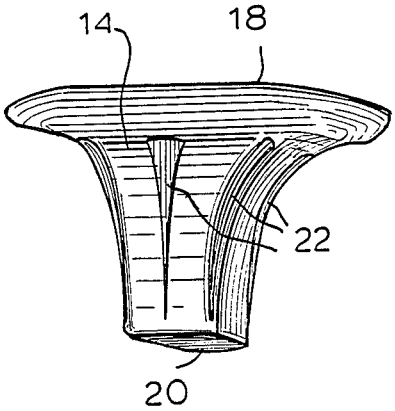
Fig. 6
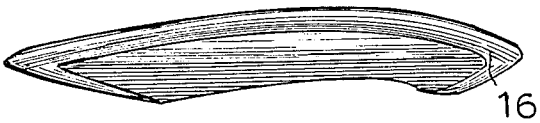
Fig. 7

SHOCK ABSORBING DEVICE FOR HIGH HEEL FOOTWEAR

BACKGROUND OF THE INVENTION

1. Field of the Invention

This invention relates to a flexible, energy absorbing orthotic device for high heel footwear and a method for its manufacture.

2. Background of the Related Art

One of mankind's most unique footwear designs has to be that of the ladies high heel shoe. By raising the heel higher than that of the natural foot angle, the woman's natural walking pattern is altered, resulting in higher impulsive loads on the musculoskeletal system. In an investigation utilizing small low-mass piezoelectric accelerometers attached to the skin surface of both tibial tuberosities, the heel and metatarsal strike acceleration values began to exceed the barefoot values in the heel height ranges of 1.75 to 2.25 inches. See, FIG. 8 which is a graph showing the acceleration values generated at the tibial tuberosities from the heel(H) and metatarsal(M) region by a ladies low heel shoe having a 0.2 inch heel with no insole; and FIG. 9 which is a graph showing the acceleration values generated from the heel(H), and metatarsal(M) region by ladies high heel shoes having a 2.6 inch heel with no insole.

The phenomena of the metatarsal strike exists in every type of human locomotion, such as walking, running, hopping, jumping, stair climbing, and the like. Not much attention has been paid to this phenomena, however, simply because there has been a lack of appropriate or accurate measuring techniques. It is true, that this second acceleration value is rather negligible during regular low heel or barefoot walking, which may be the reason that it has not been discussed in prior literature. However, with increasing heel height, the effect of the metatarsal strike becomes more and more profound. As shown in FIGS. 8 and 9, our measurements indicate that for a subject wearing a 2.6" heel, in addition to the conventional heel strike, a metatarsal strike of magnitude similar to that of a 0.2" low heel strike is observed. In practical or layman's terms, this means that when wearing a shoe with the aforementioned size heel, the human musculoskeletal system is subjected to approximately twice as much abuse as when walking barefoot, or, the damage induced on the musculoskeletal system is equivalent to that of when the subject is covering twice as much distance. The quantitative evaluation for the heel strike accelerations of 3.0 inch high heel shoes attained a level of over 175% that of flat shoe heel strike values. The force due to acceleration of the 3.0 inch high heel shoe was 130% greater than that of the barefoot case and the heel strike value for a 2.6" high heel was 125% greater than that of a flat shoe heel. Thus, the need to provide shock absorption in ladies high heel shoes is not only from heel strike initiated shock waves, but also from the metatarsal strike initiated waves.

Previously, shock attenuating insoles have been developed for men's, ladies' and children's footwear for use in boots, athletic shoes, and walking shoes U.S Pat. Nos. 4,187,621; 4,435,910; and 4,364,188 utilize closed cell foams and other materials having a high compression set which permanently deform under the load of the wearer, resulting in reduced comfort and effectiveness. These materials also do not absorb perspiration and/or odors and prevent aeration of the insole. Such materials include closed cell polyvinylchloride and polyolefin foams, closed cell neoprene foam and chemically blown natural and synthetic latex rubber foams.

U.S. Pat. Nos. 3,475,837; 2,350,362, 2,074,050; 1,724,349, 1,717,122; and 482,561 describe the construction of mens and ladies shoes with indentations in the heel portions. These shoes utilize soft or resilient pads positioned over and in the indentations for cushioning the user's heel. None of these designs is effective in reducing the acceleration due to heel and metatarsal strike initiated shock waves from ladies high heel shoes. Also, none of these designs attempt to reduce the acceleration resulting from metatarsal strike initiated shock waves.

U.S. Pat. No. 2,083,581 describes a women's high heel shoe with adjustable heel and metatarsal pads for modifying the sole conformation to better fit individual customers. The insole, heel and metatarsal pads are not intended and cannot reduce the acceleration force resulting from heel and metatarsal strike initiated shock waves because there are no energy attenuating materials incorporated in U.S. Pat. No. 2,083,581.

U.S. Pat. No. 4,335,530 describes mens and ladies high heel pumps with indentations in the heel and metatarsal regions. A pad protrudes from the midsole into an indention in the heel, and another pad in the metatarsal region of the midsole protrudes through the bottom of the sole near the metatarsal region, allowing the midsole to make contact with the ground, after impact by the sole. The midsole is made from a compressible, low density resilient foam material, as discussed above, such resilient materials are well known in the art as those which will not absorb the shock and resulting vibration of heel and metatarsal strike. In addition, the midsole construction of this patent requiring a fixed, nonremovable insole and also requires the insole to include a wear resistant layer below the metatarsal region for making contact with the ground.

U.S. Pat. No. 3,414,988 describes an insole for use in athletic shoes, made of a relatively thick resilient cushioning layer of porous plastic foam and at selected areas, a relatively thin, substantially non-resilient, shock absorbing ply of unicellular plastic foam.

U.S. Pat. No. 4,232,457 describes an orthotic insert comprised of a flexible plastic support member of incompressible material and a heel post made of a compressible, resilient material, such as an open cell natural sponge rubber. Resilient materials are well known in the art as those which will not absorb the shock and resulting vibration of a heel strike.

U.S. Pat. No. 4,541,184 describes the manufacture of a composite insole from an upper layer of flexible material bonded to a shock absorbing high density polyurethane material. This insole is unusually bulky and heavy due to the extension of the high density polyurethane material over the entire length of the insole, thus it cannot be inserted and comfortably worn in ladies high heel shoes. Several energy absorbent compositions are described in U.S. Pat. Nos. 4,101,704; 4,346,205 and 4,476,258.

Commonly assigned U.S. patent application Ser. No. 011,830 filed on Feb. 6, 1987 (Assignee: Polymer Dynamics, Inc., Lehigh Valley., Penn. 18001), describes a flexible resilient laminate and an insole fabricated therefrom by means of an overcharging process. There is no disclosure in Ser. No. 011,830 regarding the manufacture of an insole for ladies high heel shoes.

U.S. Pat. Nos. 4,581,187 and 4,674,204 describe the preparation of shock absorbing cushioned insoles. Neither of these patents, however, describe the manufacture and use of shock absorbing insoles for ladies high heel shoes. Accordingly, the insoles described therein are too large and bulky to be inserted and comfortably worn in ladies high heel hoes.

Many types of insoles have been proposed for various types of footwear. However, none have been able to reduce the amplitude of the heel strike initiated shock wave or the magnified metatarsal strike initiated shock wave by as much as the present invention while maintaining the classical shape of the ladies high heel shoe. All prior shock absorbing insoles occupy too great a volume to make their use practical and comfortable in a ladies high heel shoe. Likewise, the magnitude of the metatarsal strike initiated shock wave generated with the use of high heel shoes has heretofore been undisclosed.

Accordingly, it is an object of this invention to provide a shock absorbing insole for high heel footwear to reduce the amplitude of the heel strike shock wave, as well as the metatarsal strike shock wave, thereby reducing the risk of low back pain, debilitating joint disorders, osteoarthrosis, myositis of the calf, thigh and back and the like.

It is also an object of this invention to provide an orthopedically and biomechanically designed insole which offers cushioning for effective redistribution of the pressure between the sole of the foot and the shoe, henceforth, decreasing the possibility of callous and blister development.

Yet another object of the invention is to provide a functional, composite insole whose incorporation in high heel footwear will modify and dissipate the shock waves which propagate through human musculoskeletal system after each step.

SUMMARY OF THE INVENTION

The foregoing and related objects are achieved by a new composite high heel shoe insole and method of manufacturing the insole of the present invention. The insole is comprised of an open cell, microcellular, flexible polyurethane foam having low compression set and an energy-absorbing viscoelastic polymer component in the heel and/or metatarsal regions of the insole. This insole will moderate the risk of degenerative joint disorders, low back pain and osteoarthrosis.

The insole of this invention modifies and dissipates shock waves which propagate through the human musculoskeletal system after each step when wearing high heel shoes, these shock waves are initiated by both the heel and metatarsal strike, whereas, with a flat shoe, the metatarsal strike is insignificant. This double strike occurs because the wearing of a high heel shoe creates a walking style with a larger than normal heel strike followed by a metatarsal strike of similar magnitude. The cushion of viscoelastic polyurethane elastomer is, therefore, advantageously employed at the metatarsal region of the insole in combination with the viscoelastic heel cushion in the present invention.

BRIEF DESCRIPTION OF THE DRAWINGS

These and other features and advantages of the present invention are described in connection with the accompanying drawings, in which:

FIG. 5 is a top plan view of the high heel shoe insole illustrated in FIGS. 1–3;

FIG. 6 is a perspective view of the heel plug illustrated in FIGS. 1–4;

FIG. 7 is a perspective view of the metatarsal insert illustrated in FIG. 1–5;

DETAILED DESCRIPTION OF THE PREFERRED EMBODIMENTS

Figure 1:
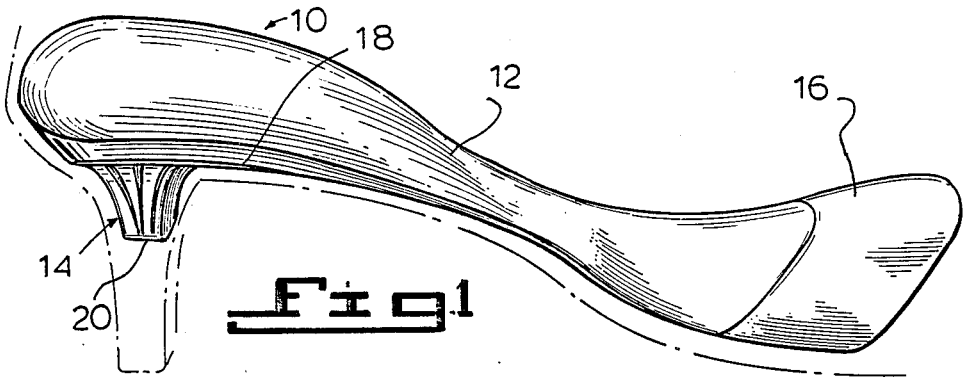
FIG. 1 is a perspective view of the high heel shoe insole of the present invention with the shoe shown in phantom.
Figure 2:
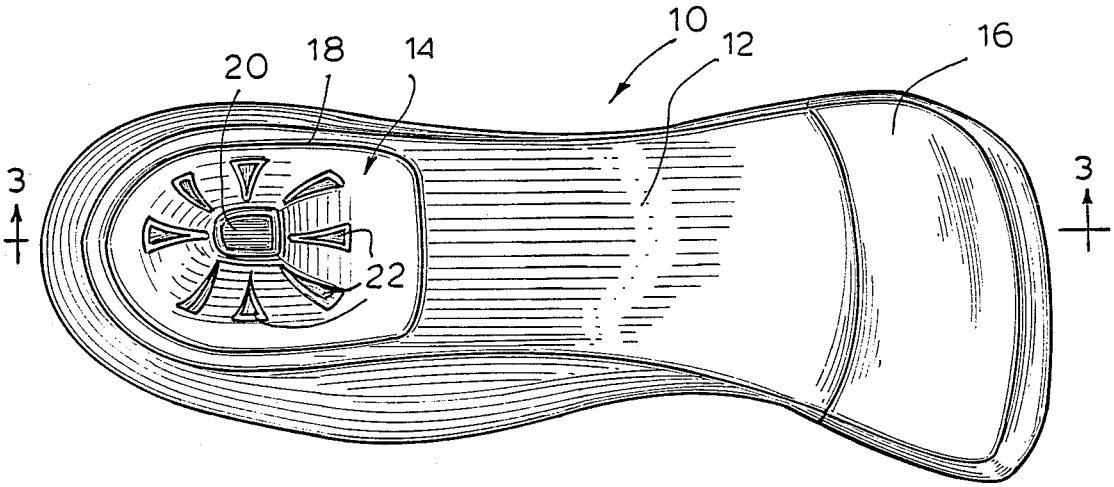
FIG. 2 is a bottom plan view of the high heel shoe insole illustrated in FIG. 1.
Figure 3:
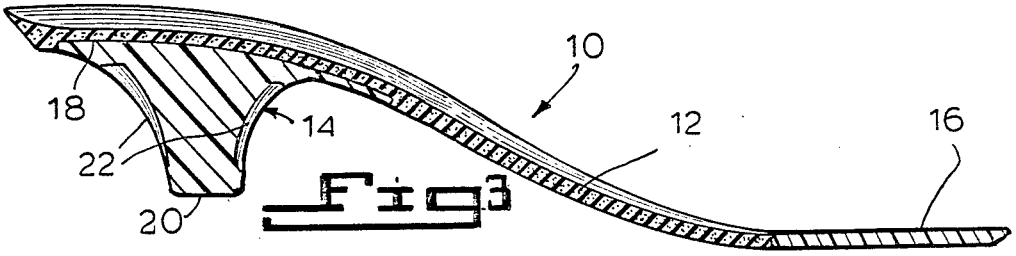
FIG. 3 is an elevational, longitudinal cross-sectional view of the high heel shoe insole illustrated in FIG. 2 taken along axis 3—3 shown in the direction of the arrows.

According to the present invention, one preferred method of manufacturing preferred high heel insole 10 includes pouring of the shock absorbing, viscoelastic polyurethane liquid or the placing of the solid shock absorbing, viscoelastic elastomer material into the lower portions of an open mold. These lower portions of the mold, preferably include the heel bucket or heel insert, the metatarsal insert area or both. Soon after the viscoelastic polyurethane is placed in the mold, a foamable polyurethane reaction mixture is introduced into the lower portion of the mold over or adjacent to the viscoelastic polyurethane composition. The foamable material may be injected into a closed mold by means of a reaction injection molding (RIM) process, or a low pressure open mold foam pouring procedure may be utilized, the details of which are well known in the art.

After the foam has been introduced into the mold, the mold is closed and remains closed until the elastomeric material and foam material are sufficiently cured to be demolded. It is also possible to manufacture the elastomeric material in a fully cured state prior to having introduced the material into the mold where it will be formed with the foam material. Following the demolding and an appropriate post cure time, the resulting high heel, flexible, resilient insole is die cut to size.

The materials of construction are open-cell, microcellular, flexible, resilient polyurethane foam of low compression set and a solid energy absorbing, viscoelastic elastomer polymer component.

A. The Insole Footbed Based on an Open-Cell, Microcellular, Flexible, Resilient Polyurethane Foam of Low Compression Set The open-cell, flexible, resilient polyurethane elastomer foam utilized in the construction of the high heel shock absorbing insole of the present invention can be based on the reaction of a di- or higher functional, particularly di- and/or tri-hydroxy, polyesters, polyethers, polyacetates, polycarbonates, polyesteramides and polybutadienes with aromatic, alicyclic, and/or aliphatic isocyanates, among others.

Examples of numerous polyol containing compounds suitable for fabricating the polyurethane foam cushioning element of the insole of the present invention are described, for example, by Saunders and Frisch, in High Polymers, Vol. XVI, "Polyurethanes, Chemistry and Technology" Interscience Publishers, New York, London, Vol. I, 1962, pages 32 to 42 and 44 to 54 and Vol. II, 1969, pages 5–6 and 198–199, the disclosure of which is incorporated by reference herein. Suitable polyisocyanates of the type known in the art include the compounds described, for example, by W. Siefken, in *Annalen der Chemie,* 562, pages 75–136 [date].

The preferred group of polyols are polyether polyols. Representative polyols having from 2 to about 8 active hydrogen atoms and an equivalent weight of from about 400 to 4000, preferably from about 1000 to about 3000, and still more preferably from about 1500 to about 2100. In order to achieve the desired high reactivity of the polyalkylene polyether polyols employed in the present invention, the polyols should possess at least about 25% primary hydroxyl groups and more preferably from about 40% to about 80% or higher of these groups. Such polyalkylene ether polyols having an average of at least two hydroxyl groups per molecule are converted to open-cell microcellular polymers having specific gravities of from about 0.1 gm/ml to about 0.4 gm/ml or somewhat higher by reacting with polyisocyanates in the presence of water and/or organic blowing agents in the presence of catalysts, foaming aids, additives, and optionally, extending and/or cross-linking agents.

In the event it is desired to manufacture molded open-cell microcellular polyurethane elastomers exhibiting hydrophilic properties, it is advantageous to utilize liquid polyoxyethylene/oxypropylene copolymers which contain from about 50% to as high as about 85% or even higher, of oxyethylene units on a molar basis of total alkylene oxide. It is further preferred to have random distribution of the oxyalkylene units to facilitate moisture absorption of the resulting polyurethanes thereby enabling the resulting materials to absorb and release perspiration and its consequent odors.

The preparation of the polyether polyols can be performed in accordance with techniques which are well known in the art; basically, the reaction of a polyhydric starter, or initiator, with propylene and ethylene oxides in the presence of an oxyalkylation catalyst. The catalyst is typically an alkali metal hydroxide such as, for example, lithium hydroxide. The oxyalkylation of the polyhydric initiator can be carried out at temperatures ranging from about 80° C. to about 150° C. and is usually at an elevated pressure up to about 200 p.s.i.g. employing sufficient amounts of the propylene and ethylene oxides and adequate reaction time to obtain a polyol of the desired molecular weight.

Any suitable dihydric and/or polyhydric initiator(s) can be employed When forming diols, illustrative examples include water, propylene glycol, ethylene glycol, 1,3-propane diol, dipropylene glycol, diethylene glycol, 1,4-butanediol, pentylene glycol, aniline, and the like. In the formation of triols, glycerine, trimethylolpropane, triethanolamine, trimethyloethane, 1,2,6-hexanetriol or the like may be utilized. Other useful initiators are known in the art where tetra- and still higher functional products are desired.

Polymer/polyols, for example, those prepared by polymerizing a vinyl monomer or monomers in situ in the ethylene oxide capped polyols described above, can be used in the preparation of the polyurethane foam component of the high heel insole. Useful monomers are described in various prior patents including U.S. Pat. Nos. 3,304,273 and 3,383,351, the disclosure of which are incorporated by reference herein.

The normal polyols, such as the polyether/polyols, for example, as characterized above can be used in combination with polymer/polyols at any desired ratio to alter the stiffness or hardness of the microcellular polyurethane foam. As the amount of the polymer/polyol is increased, the hardness of the open cell foam increases proportionally, thus providing the ability to mold a polyurethane foam of varying stiffness. "Normal polyether/polyols" are those without any vinyl or polyurea polymer particles dispersed therein. "Polymer polyether/polyols" refer to stable dispersions of polymers in polyether polyols. Mixtures of normal polyether polyols, polyol/polyether polyols, and combinations thereof are included within the scope of this invention.

Examples of polyisocyanates which are useful in the preparation of the open-cell microcellular polyurethane foam component of the shock absorbing insole for high heel footwear include 1,6-hexamethylene diiosocyante, 1,12-dodecane diisocyanate, cyclobutate 1,3-diisocyanate, cyclohexane-1,3- and 1,4-diisocyanate and mixtures of these isomers; 1-isocyanato-3,5-trimethyl-5-isocyanato methyl cyclohexane (see e.g., German Patent No. 1,202,785); 2,4- and 2,6-hexahydrotolylene diisocyanate and mixtures of these isomers; perhydro-2,5'- and/or 4,4'-diphenylmethane diisocyanate, 1,3- and 1,4-phenylene diisocyanate, 2,4- and 2,6-tolylene diisocyantate and mixtures of these isomers; diphenylmethane-2,4' and/or 4,4'-diisocyanate, naphthylene-1,5-diisocyanate, triphenylmethane-4,4',4"-triisocyanate, polyphenylpolymethylene polyisocyanates of the type obtained by condensing aniline with formaldehyde followed by phosgenation as described, for example, in British Patent Nos. 874,430 and 848,671; perchlorinated aryl polyisocyanates of the type described in German Patent No. 1,157,601; polyisocyanates of the type described in German Patent No. 1,157,601; polyisocyanates containing carbodiimide groups of the type describe in U.S. Pat. No. 4,198,489 and diisocyanates described in the same U.S. Patent; polyisocyanates containing allophanate groups of the type described, for example, in British Patent No. 994,890; polyisocyanates containing isocyanurate groups of the type described, for example, in West German Patent Nos. 1,022,789; 1,222,067; 1,027,394; 1,929,304, and 2,004,048; polyisocyanates containing urethane groups of the type described, for example, in U.S. Pat. No. 3,394,164; polyisocyanates containing acylated urea groups as described in German Patent No. 1,230,778; polyisocyanates containing biuret groups of the type described, for example, in German Patent No. 1,101,392; British Patent No. 889,050; and French Patent No. 7,017,514; polyisocyanates obtained by telomerization reactions of the type described, for example, in Belgian Patent No. 723,640; polyisocyanates containing ether groups of the type described, for example, in U.S. Pat. No. 3,567,763; and, reaction products of the aforementioned isocyanates with acetals as described in German Patent No. 1,072,385.

It is also possible to use the distillation residues containing isocyanate groups accumulating in the commercial production of isocyanates, optionally, in solution in one or more of the aforementioned polyisocyanates. In addition, it is possible to use mixtures of the aforementioned polyisocyanates.

In general, it is particularly preferred to use the readily available polyisocyanates such as 2,4- and 2,6-tolylene diisocyanate and mixtures of these isomers ("TDI"), polyphenylpolymethylene polyisocyanates of the type obtained by condensing aniline with formaldehyde followed by phosgenation ("crude MDI") and, polyisocyanates containing carbodiimide groups, urethane groups, allophanate groups, isocyanurate groups, urea groups, or biuret groups ("modified polyisocyanates").

According to the formulation for the open-cell microcellular polyurethane foam portion of this invention, water and/or readily volatile organic substances are used as blowing agents. Organic blowing agents include acetone, ethyl acetate, halogen-substituted alkanes such as methylene chloride, monofluorotrichloromethane, chlorodifluoromethane and dichlorodifluoromethane, hexane, and the like. Catalysts which can be employed for the purpose of accelerating the polyurethane-forming reaction include the following: (a) tertiary amines such as bis(dimethylaminoethyl)ether; 1,4-diazabicyclo[2,2,2]-octane; 1,8-diazabicyclo[5,4,0]-undecene-7 and its salts with phenol and organic monocarboxylic acids, and many others, all well known in the art; (b) tertiary phosphines such as trialkylphosphines, and the like; (c) strong bases such as alkali and alkaline earth metal hydroxides, alkoxides, and phenoxides; (d) acidic metal salts of strong acids such as ferric chloride, stannic chloride, stannous chloride, antimony trichloride, bismuth nitrate and chloride, and the like; (e) chelates of various metals such as those which can be obtained from acetylacetone, benzoylacetone, trifluoacetylacetone, ethyl acetoacetate, salicylaldehyde, cyclopentanone-2-carboxylate, acetylacetoneimine, bis-acetylacetonealkylenediimines, salicyaldehydeimine, and the like, with various metals such as Be, Mg, Zn, Cd, Pb, Ti, Zr, Sn, As, Bi, Cr, Mo, Mn, Fe, Co, Ni, or such ions as $MoO_2$++, and the like; (f) alcoholates and phenolates of various metals such as Ti(OR)4, Sn(OR)4, and the like, wherein R is alkyl or aryl, and the reaction products of alcoholates with carboxylic acides, beta-diketones, and 2-(N,N-dialkylamino)alkanols, such as the well known chelates of titanium obtained by these or equivalent procedures; (g) salts of organic acids with a variety of metals such as alkali metals, alkaline earth metals, Al, Sn, Pb, Mn, Co, Ni, and Cu including, for example, sodium acetate, potassium laurate, calcium hexanoate, stannous acetate, stannous octoate, stannous oleate, lead octoate, metallic driers such as manganese, and the like; and (h) organometallic derivatives of tetravalent tin, trivalent and pentavalent As, Sb, and Bi and metal carbonyls or iron and cobalt.

Among the organotin compounds that deserve particular mention are dialkyltin salts of carboxylic acids, e.g., dibutyltin diacetate, dibutyltin dilarate, dibutyltin maleate, and the like. Similarly, there can also be used trialkyltin hydroxide, dialkyltin oxide, dialkyltin dialkoxide and dialkyltin dichloride. Examples of these compounds include trimethyltin hydroxide, tributyltin hydroxide, trioctyltin hydroxide, dibutyltin oxide, dioctyltin oxide, dilauryltin oxide, and the like.

The aforementioned tertiary amines can be used as primary catalysts for accelerating the reactive hydrogen/isocyanate reaction or as secondary catalysts in combination with one or more of the above-noted metal catalysts. Metal catalysts, or combination of metal catalysts, can also be employed as the accelerating agents without the use of amines. The catalysts are employed in catalytically significant quantities, for example, from about 0.001 percent to about 2 percent, based on weight of the reaction mixture.

Further additives which can be used include surface active agents, cell regulating agents, stabilizers, dyes, plasticizers, pigments, and the like.

Examples of suitable surface active agents or emulsifiers include the sodium salts of castor oil sulphonates or salts of fatty acids with amines, such as diethylamine oleate or diethanolamine stearate. Alkali metal or ammonium salts of sulphonic acids, for example of dodecylbenzenesulphonic acid or dinaphthylmethanedisulphonic acid, or of fatty acids such as ricinoleic acid or of polymeric fatty acids, can also be used as surface active additives.

Suitable stabilizers include polyether siloxanes, especially those which are water-soluble. Foam stabilizers of this type are described for example, in U.S. Pat. Nos. 2,834,748; 2,917,480; and 2,629,308.

Anti-foaming agents or cell regulating agents which are useful include the polydimethylsiloxanes having viscosities of from about 3 to about 500 centistokes at 25° C.; polyphenylmethylsiloxanes such as those described in U.S. Pat. No. 4,042,537; mineral oils; polyether polyols comprising copolymers and block copolymers of ethylene and propylene oxides; and the like. Foam stabilizers and cell regulators are used in concentrations of 0.01 to about 3 percent by weight and higher, based upon the weight of all foam ingredients. Preferred cell regulating agents are the polydimethylsiloxanes having viscosities from about 3 to about 20 centistokes at 25° C. Examples of these products include DC 200 fluids (available from Dow Corning Corporation), Dow Corning Antifoam 1500 and SF-96-5 (available from General Electric).

In addition to water which acts as an extender and blowing agent and can be used at concentrations of about 0.5 parts to as high as about 3.0 or more parts per hundred quantities, for example, from about 0.2 to about 3 parts or higher, per hundred parts of polyol, of reactive extenders containing hydroxyl and or amino groups. Typical extenders include ethylene glycol, 1,4-butanediol, 1,5-pentanediol, 1,6-hexanediol, diethylene glycol, triethylene glycol, dipropylene glycol, diethanolamine, diisopropanolamine, triethanolamine, triisopropanolamine, and the like.

The open-cell microcellular polyurethane foam of the shock absorbing insole for a ladies high heel shoe has a specific gravity of about 0.24 to about 0.65 or higher, with a Shore "A" hardness of between about 1 and 30, or higher and a ball rebound resilience in the range of approximately 40 to 60. The term "microcellular" as used to characterized the polyurethane foam is intended to designate cell structure which appears to be essentially solid to the naked eye. The average diameter (cell size) of the microcells will often vary from about 0.1 mm or less to about 0.2 mm or somewhat higher, depending on choice of cell control agents, mold temperature, mold pressure, catalyst and reactivity of the reaction components among other factors as will be appreciated by those skilled in the art.

In Examples 1 and 2 which follow, the components of suitable polyurethane foam for the shock absorbing high heel insole are as follows:

NIAX POLYOL 11-27 (Union Carbide Corporation) A high primary hydroxyl-containing poly(oxyethyleneoxypropylene)-triol/diol mixture containing about 15% by weight of ethyleneoxy units as end caps, a hydroxyl number of about 27, a hydroxyl equivalent weight of about 2050; and a viscosity of about 1220 centistokes at 25° C.

NIAX POLYOL E-519 (Union Carbide Corporation)

A polymer polyol comprising about 70% by weight of a poly(oxypropylene)/polyol, 20% by weight of styrene, and 10% by weight of acrylonitrile asvvinyl polymer thereof, and having a hydroxyl equivalent weight of about 2650.

L-5309 Surfactant (Union Carbide Corporation)

A polyoxethylene-polysiloxane surfactant having a specific gravity of 1.0 at 25° C., and a viscosity of 225 centistokes at 25° C.

SF-96-5 (General Electric Company)

A dimethylsilicone oil having a viscosity of 3.5 centistokes.

DABCO EG (Air Products & Chemicals, Inc.)

A liquid blend catalyst consisting of one third by weight of 1,4-diazabicyclo[2,2,2]octane and two thirds by weight of ethylene glycol.

POLYCAT SA-102 (Air Products & Chemicals, Inc.)

A salt comprising 51% by weight of 1,8diazabicyclo[5,4,0]undecene-7, and 49% by weight of 2-ethylhexanoic acid.

UL-1 (Witco Chemical Corporation Organics Division)

A dibutyltin sulfide dissolved in plasticizer.

UV-Stabilizers (Ciba Geigy Corporation)

Tinuvin P, Tinuvin 328, and Tinuvin 765.

White Pigment 4100 (Pigment Dispersions, Inc.)

A titanium dioxide pigment dispersed in a polyether polyol (about 40% by weight solids)

MONDUR CD (Mobay Chemical Company)

A liquid mixture of 4,4'-diphenylmethane diisocyanate, its carbodiimide, and/or its trifunctional cycloadduct. The isocyanate equivalent weight is 144; the NCO content is 29.3% by weight.

The above components were formulated into two reaction mixtures (Examples 1 and 2) providing open-cell polyurethane foams which are suitable for the shock absorbing device for high heel footwear. The formulations are shown in Table 1.

TABLE 1

| Component | Example 1 | Example 2 |
|---|---|---|
| NIAX Polyol 11-27 | 100.00 | 50.00 |
| NIAX Polyol E-519 | — | 50.00 |
| Diethanolamine | 0.40 | 0.40 |
| Water | 1.20 | 1.20 |
| Surfactant L-5309 | 2.00 | 2.00 |
| Silicone SF-96-5 | 0.20 | 0.20 |
| Dabco EG | 1.00 | 1.00 |
| Polycat SA-102 | 0.40 | 0.40 |
| Polycat 60 | 0.15 | 0.15 |
| Tin Catalyst UL-1 | 0.02 | 0.02 |
| White Pigment | 4.00 | 4.00 |
| Trichlorofluoroethane | 3.00 | 3.00 |

The above, polyurethane foam reaction mixture components were thoroughly blended and foamed with Mondur CD. The ratio of polyol to isocyanate was 100:27.9 and the foamable mixture was dispensed by means of a two component machine into an open mold cavity. At an aluminum mold temperature of about 50°–55° C., demolding can occur after about 4 minutes.

Example 1 represents a formulation which results in a relatively soft foam comprised of polyether/polyols only while Example 2 is designed for a medium stiffness open-cell material and contains equal amounts of polymer/polyol and polyether/polyol. The foam of Example 1 results in a compression set of about 15 to 20% when subjected to 25% compression for 22 hours at 25° C. The open-cell foam of Example 2 exhibits a compression for 22 hours at 25° C. The open-cell foam of Example 2 exhibits a compression set (ASTM D-395, Method B) of 5–10% when subjected to a compression of 50% for 22 hours at 35° C. As such, they are very well suited for the shock absorbing high heel insole of the present invention.

B. The Energy-Absorbing Viscoelastic Polvmer Component

The viscoelastic, shock- and energy-absorbing viscoelastic polyurethane elastomer component incorporated into the high heel device can be of solid or foamed elastomer having a high hysteresis loss over a temperature range similar to that encountered in its application, namely, from 10° C. to 50° C. and perhaps even higher, over a hardness range as measured by ASTM D2240 of from about 15 to 85, or more preferably from about 35 to 55; and a very low rebound resiliency, for example, of about 2–15% and preferably lower, based on the Zwick rebound test (DIN 13014). These two properties, the high hysteresis loss and the low rebound resiliency are a relative measure of the material's ability to absorb energy and moderate shock forces by reducing the amplitude of the heel and metatarsal strike initiated shock waves when the foot of the human skeletal system is subjected to impact.

A solid viscoelastic polymer based on polyurethane which is particularly suitable for the heel portion of this invention is described in commonly assigned U.S. Pat. No. 4,722,946, incorporated by reference herein, and is commercially available (VISCOLITETM, Polymer Dynamics, Inc., Lehigh Valley, Penn.). In accordance with the invention described and claimed in U.S. Pat. No. 4,722,966, energy-absorbing polyurethane elastomers are provided which are prepared by reacting a blend of linear and branched polyols, optional cross-linkers and/or chain extenders if desired, a polyisocyanate and, optionally a blowing agent, in the presence of a catalyst at an isocyanate index range of from about 65 to 85. The isocyanate index is defined as follows:

$$\text{Isocyanate } (NCO) \text{ Index} = \frac{\text{Equivalents of } NCO}{\text{Equivalents of reactive hydrogen as determined by the Zerewitinoff test.}} \times 100$$

The following physical testing methods, reactants and polymer preparation procedures are common to Examples 3–18 which are illustrative of the preparation of energy-absorbing viscoelastic polyurethane components of the high heel insole of this invention.

A. Physical Testing Methods

Apparatus used in evaluating physical testing of the viscoelastic elastomers includes Shore "00"hardness according to ASTM D2240, resilience according to the Zwick Rebound Pendulum DIN 53512, ball rebound resilience according to ASTM D-2632 and tension testing according to ASTM D-412.

B. The Reactants

The reactants employed in the examples are described therein and in the accompanying tables. All polyols were degassed at 80°–90° C. under vacuum (15 mm Hg) for two hours to remove air and moisture.

All fillers were dried in an oven at 150° C. for eight hours and then heated in a vacuum oven to constant weight to remove moisture.

C. Polymer Preparation

In all of the examples which follow, the same general procedure for preparing polyurethane elastomers was employed. Thus, the polyol blend of polyols, catalysts, antifoam agents, and the like was pre-mixed followed by degassing the mixture at room temperature to eliminate all dissolved air. After adding the isocyanate thereto, the reactants were mixed, quickly degassed at room temperature until the bubbling subsided, and the material was poured into an open mold and allowed to cure in said mold for between 3 and 10 minutes. All samples prepared for physical property testing were demolded and allowed to post-cure for three to five days at ambient temperature in accordance with the ASTM or DIN methods.

The properties of the polyurethanes of Examples 3–18 are shown in Tables 2–4.

TABLE 4

| POLYOL RATIO:LINEAR:BRANCHED (BY EQUIVALENT) - 1.00:0.79 | | | |
|---|---|---|---|
| EXAMPLE | 16 | 17 | 18 |
| NIAX DIOL PPG 2025[1] | 90.0 | 90.0 | 90.0 |
| PLURACOL TP 440[2] | 10.0 | 10.0 | 10.0 |
| RATIO:LINEAR: BRANCHED BY EQUIVALENT | 1.00/0.79 | 1.00/0.79 | 1.00/0.79 |
| DABCO EG | 0.5 | 0.5 | 0.5 |
| POLYCAT SA-102[3] | 1.0 | 1.0 | 1.0 |
| ISONATE 143-L[4] | 24.6 | 22.1 | 19.2 |
| INDEX | 100 | 90 | 80 |
| SHORE "00" HARDNESS | | | |
| 1 DAY | 83 | 74 | 48 |
| 2–3 WEEKS | 85 | 76 | 54 |
| ZWICK RESILIENCE, % | 41.3 | 29.0 | 14.7 |
| BALL REBOUND RESILIENCE, % | 27.0 | 21.0 | 13.0 |

[1]Polypropylene glycol having a molecular weight of about 2000 available from Union Carbide Corporation.
[2]Propylene oxide adduct of trimethylolpropane having a molecular weight of about 420–425 available from BASF Corporation.
[3]Air Products Corporation; a salt comprising 51% by weight of 1.8-diazobicyclo (5.4.0) undecene -7 and 49% by weight of 2-ethylhexanoic acid.
[4]Dow Chemical Company; a carbodiimide derivative of 4,4'-di-phenylmethane diisocyanate having an isocyanate equivalent weight of approximately 143–145.

In Examples 3–18, mixtures of relatively low molecular weight branched polyether polyols and fairly high molecular weight polypropylene glycols were prepared. The preparations of Examples 3–9 had a linear to branched equivalent ratio of 1:2.36 which resulted in viscoelastic elastomer products which are very suitable as the heel bucket energy-absorbing component of the present invention. At this ratio of linear to branched,

TABLE 2

| EFFECT OF ISOCYANATE INDEX ON PHYSICAL PROPERTIES POLYOL RATIO:BRANCHED (BY EQUIVALENT) - 1.00:2.36 | | | | | | | |
|---|---|---|---|---|---|---|---|
| EXAMPLE | 3 | 4 | 5 | 6 | 7 | 8 | 9 |
| NIAX DIOL PPG 2025[1] | 60.0 | 60.0 | 60.0 | 60.0 | 60.0 | 60.0 | 60.0 |
| PLURACOL TP 440[2] | 20.0 | 20.0 | 20.0 | 20.0 | 20.0 | 20.0 | 20.0 |
| RATIO:LINEAR: BRANCHED BY EQUIVALENT | 1.00/2.36 | 1.00/2.36 | 1.00/2.36 | 1.00/2.36 | 1.00/2.36 | 1.00/2.36 | 1.00/2.36 |
| DABCO EG | 0.4 | 0.4 | 0.4 | 0.4 | 0.4 | 0.4 | 0.4 |
| POLYCAT SA-102[3] | 0.8 | 0.8 | 0.8 | 0.8 | 0.8 | 0.8 | 0.8 |
| MONDUR CD | 30.1 | 27.1 | 25.1 | 24.1 | 22.6 | 21.1 | 19.6 |
| INDEX | 100 | 90 | 85 | 80 | 75 | 70 | 65 |
| SHORE "00" HARDNESS | | | | | | | |
| 1 DAY | 90 | 86 | 82 | 77 | 70 | 63 | 40 |
| 2–3 WEEKS | 93 | 91 | 90 | 85 | 82 | 74 | 65 |
| ZWICK RESILIENCE, % | 12.3 | 11.0 | 11.0 | 10.8 | 10.5 | 10.0 | 8.0 |
| BALL REBOUND RESILIENCE, % | 7.0 | 7.0 | 7.0 | 7.0 | 7.0 | 6.5 | 6.0 |
| TEAR RESISTANCE, PLI. | 53.9 | 37.4 | 26.3 | 18.5 | 13.6 | 9.1 | 6.3 |

TABLE 3

| POLYOL RATIO:LINEAR:BRANCHED (BY EQUIVALENT) - 1.00:1.18 | | | | | | |
|---|---|---|---|---|---|---|
| EXAMPLE | 10 | 11 | 12 | 13 | 14 | 15 |
| NIAX DIOL PPG 2025[1] | 60.0 | 60.0 | 60.0 | 60.0 | 60.0 | 60.0 |
| PLURACOL TP 440[2] | 10.0 | 10.0 | 10.0 | 10.0 | 10.0 | 10.0 |
| RATIO:LINEAR: BRANCHED BY EQUIVALENT | 1.00/1.18 | 1.00/1.18 | 1.00/1.18 | 1.00/1.18 | 1.00/1.18 | 1.00/1.18 |
| DABCO EG | 0.4 | 0.4 | 0.4 | 0.4 | 0.4 | 0.4 |
| POLYCAT SA-102[3] | 0.8 | 0.8 | 0.8 | 0.8 | 0.8 | 0.8 |
| MONDUR CD | 19.9 | 18.0 | 17.0 | 16.0 | 15.0 | 14.0 |
| INDEX | 100 | 90 | 85 | 80 | 75 | 70 |
| SHORE "00" HARDNESS | | | | | | |
| 1 DAY | 85 | 78 | 71 | 59 | 42 | 20 |
| 2–3 WEEKS | 80 | 84 | 79 | 74 | 65 | 50 |
| ZWICK RESILIENCE, % | 27.0 | 23.5 | 20.0 | 17.0 | 13.8 | 10.0 |
| BALL REBOUND RESILIENCE, % | 16.0 | 15.0 | 14.5 | 13.0 | 10.5 | 8.0 |
| TEAR RESISTANCE, PLI | 30.4 | 19.3 | 13.6 | 11.0 | 7.6 | 5.6 |

isocyanate indices of from about 65 to 80 resulted in elastomer products with good to excellent shock absorbing properties. At a linear to branched equivalent ratio of 1.0 to 1.18, the useful index range is from about 70 to about 85 as shown in Examples 10 to 15. At a linear to branched ratio of from about 1 to about 0.8, the useful index range is restricted to about 80.

It has been observed on the basis of numerous resiliency tests both by means of the Zwick Pendulum Rebound and the Ball Rebound Test that the most efficient energy-attenuating elastomers have resiliency levels not much higher than about 5–10%. In addition, it has been found that a correlation exits between the resiliency and the Shore "00" hardness of the polyurethane. Low resiliency products are obtained at hardness below 80–85 Shore "00". At hardnesses about 85 Shore "00", the viscoelastic elastomer can no longer be sufficiently deformed to moderate heel strike, while at durometers of 10 or lower, the resulting product behaves more like a liquid viscoelastic product rather than a solid. Consequently, the solid viscoelastic polymer component of the insole should have a Shore "00" hardness of from about 10 to about 85, preferably from about 20 to 55, and still more preferably from about 30 to 55. Isocyanate indices of from not lower than about 65 to no higher than about 85 or moderately higher, and should have a linear/branched equivalent weight ratio of from about 1:0.8 to about 1:3.5. Moreover, it has been determined that the average equivalent weight of the polyol blend should vary within the range of from about 200 to about 1200 to attain the shock moderating properties desired in order to reduce the amplitude of the heel strike initiated shock wave.

At equivalent weights of above about 1200, the resulting rebound resilience figures are too high to result in proper shock moderation, and at equivalent weights of below about 200, the resulting products tend to become too hard for the purpose intended for this invention.

In essence, the proper balancing of the equivalent weight of the polyol and the proper isocyanate index employed in the manufacture of the viscoelastic component of the present invention are critical in obtaining the energy absorbing properties necessary for the engineering of such a material.

C. Construction of the Shock Absorbing Insole for High Heel Footwear

FIG. 1 shows a perspective view of a preferred high heel shoe insole 10 of the present invention with the shoe shown in Phantom. The insole 10 comprises a contoured polyurethane foam footbed 12 and a viscoelastic polyurethane elastomeric heel plug 14 which has a wide, thin, semi-oval base which narrows and thickens as it nears the stem (following the shape of a typical high heeled shoe) and preferably, a metatarsal cushion 16 made from a viscoelastic polyurethane polymer. The elastomeric heel plug 14 may also be replaced by a flat polyurethane viscoelastic insert (not shown) which does not extend into the base of the heel so as to make the invention usable in shoes which were manufactured without a receptacle for receiving the heel plug 14.

The foam footbed 12 provides a cushioning effect to the sole of the foot by redistributing and homogenizing the contact pressure between the sole of the foot and the insole 10 whereas the heel plug 14 and metatarsal cushion 16 provide the needed shock absorption.

FIG. 6 is a perspective view of the viscoelastic polymer heel bucket 14 which has a wide thin base 18 which attaches to the foam footbed 12. As the heel bucket 14 of this insole 10 is designed for the high heel shoe, it assumes the shape of the heel of such a shoe. It is therefore, substantially frustoconically shaped, being wider near the top thin base 18 narrowing towards the bottom of the heel 20. This heel bucket 14 is comprised of the viscoelastic polyurethane elastomer described above which provides the necessary attenuation of the heel strike generated shock waves. Through testing it has been determined that the energy or shock absorbing properties of this viscoelastic material are greatly improved if relief channels 22 or voids are provided, into which the material may deform when a load is applied. Without these relief channels 22, there is no place for the material to compress to provide sufficient energy absorption.

Figure 8:
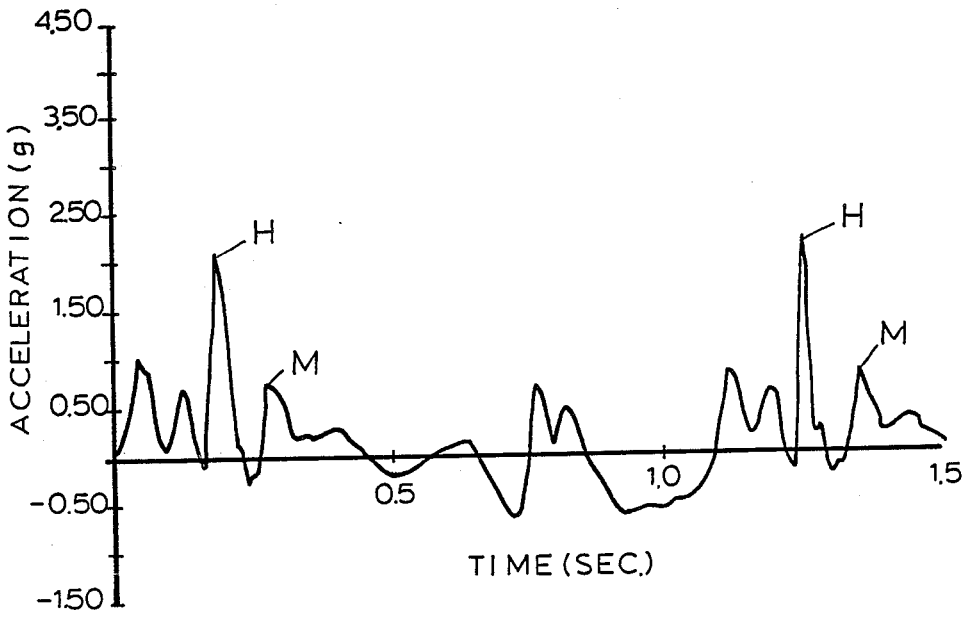
FIG. 8 is a graph showing the acceleration values generated at the tibial tuberosities from the heel (H) and metatarsal (M) region by ladies low heel shoes having a 0.2 inch heel with no insole.
Figure 9:
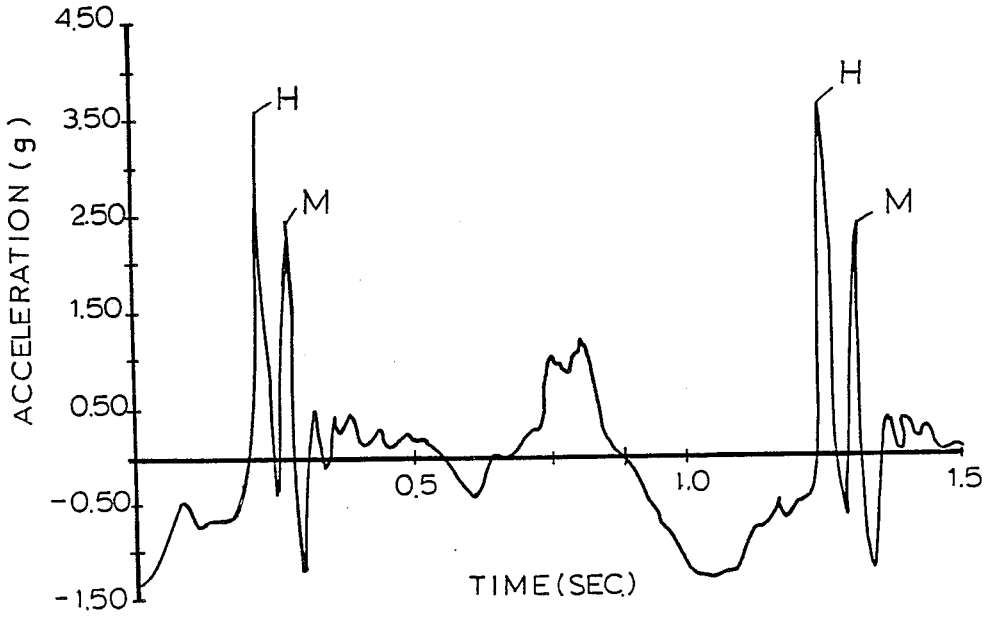
FIG. 9 is a graph showing the acceleration values generated at the tibial tuberosities from the heel (H)..and metatarsal (M) region by ladies high heel shoes having a 2.6 inch heel with no insole.

The same is true of the metatarsal cushion 16 which is shown in FIG. 7. This cushion pad 16 is also comprised of the viscoelastic polyurethane elastomer. The function of the metatarsal cushion is to reduce the amplitude of the metatarsal strike generated shock wave of the high heel gait pattern, which is magnified significantly in comparison to the low heel gait pattern. Compare FIGS. 8 and 9, where FIG. 8 is a graph showing the acceleration values generated at the tibial tuberosities from the heel (H) and metatarsal (M) region by ladies low heel shoes having a 0.2 inch heel with no insole; and, FIG. 9 is a graph showing the acceleration values generated at the tibial tuberosities from the heel (H) and metatarsal (M) region by ladies high heel shoes having a 2.6 inch heel with no insole. This increased metatarsal strike initiated shock wave has previously not been identified as a contributing factor of osteoarthrosis or other degenerative joint disorders. However, the detrimental effects of the heel strike generated shock wave on the human musculoskeletal system has been established by several researchers. See, Dickinson, et al., *The Measurement of Shock Waves Following Heel Strike While Running,* J. Biomechanics, Vol. 18, No. 6., pp. 415–422, Pergamon Press Ltd. (1985); and Light, et al., *Skeletal Transients on Heel Strike in Normal Walking with Different Footwear,* J. Biomechanics, Vol. 13, pp 477–480, Pergamon Press Ltd. (1980).

As shown in FIGS. 8 and 9, the effect of metatarsal strike is no different from a heel strike of similar magnitude. Both waves look and behave in exactly the same manner, as is evident from the readings of an accelerometer attached to the tibial tuberosity of a subject wearing high heel shoes, shown in FIG. 9. There is no way for the skeletal system to differentiate the two waves, both appear to have the same magnitude of acceleration, as shown in FIGS. 8 and 9. Thus, the human muculoskeletal system is subjected to nearly double the assault when wearing high heel shoes. Accordingly, a shock absorbing device is especially needed at both the heel and metatarsal areas of the foot.

The preferred method of manufacturing a high heel shoe insole 10 in accordance with the present invention comprises foaming the components of the foam footbed 12 in a mold with the energy absorbing component(s) 14 and 16 which have previously been placed in the mold. The viscoelastic component(s) 14 and 16 may be preformed or poured into the mold as a liquid and allowed to cure in conjunction with the foam.

The foaming reaction mixture of Example 1, which can be prepared in a machine such as that described in U.S. Pat. No. 2,764,565, is introduced into the cavity of a suitably configured mold in which the preformed viscoelastic element, in this case, the polyurethane elastomer of Example 7, has been inserted into the heel bucket portion of the mold. Suitable mold materials include metals, such as aluminum, and plastics, such as epoxy resins or polypropylene. It is highly preferred to introduce an excess amount of foamable reaction mixture into the mold, so that the expanding foam creates positive pressure when it fills the mold. Thus, it is generally preferred to introduce into the mold from about 125% to as high as about 300% or more of the foamable reaction mixture required to fill the interior of the mold. This technique, known as "over-charging" is commonly practiced in polyurethane molding processes, and is described in U.S. Pat. Nos. 3,178,490; 3,182,104 and in commonly assigned copending U.S. patent application Ser. No. 011,830. Such "over-charging" creates substantial internal pressures in the mold, ranging from (about) 5–20 psi or more, and is generally advantageous in that it provides a molded product which is substantially devoid of blow holes and/or surface blemishes.

After the molding has cured for from about 2 to 10 minutes at temperatures of from about 60° C. or above to temperatures as low as 25° C., the mold is opened and the partially cured composite high heel insole is removed and allowed to post-cure for about 24 hours at ambient temperature. The excess foam is then cut away from the insole so as to provide a smooth edge.

Figure 4:
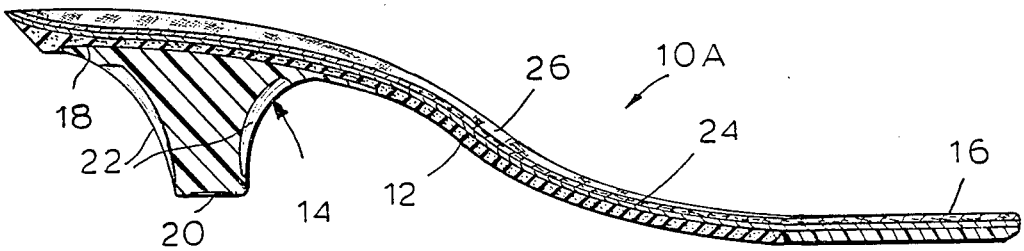
FIG. 4 is the same view described in FIG. 3, of a high heel shoe insole of the present invention, which further includes a breathable wear resistant layer and barrier layer.

An alternative preferred embodiment of the high heel insole 10A of the present invention, illustrated in FIG. 4, further includes a barrier layer 24 and a breathable wear resistant layer 26. This embodiment may be manufactured at low pressures, or preferably, it may be molded under "overcharging" conditions as described in commonly assigned U.S. patent application Ser. No. 011,830 filed on Feb. 6, 1987 which has been incorporated by reference herein, utilizing an appropriately shaped mold adapted for molding the heel plug 14 and metatarsal insert 16 of the present invention.

It is further within the scope of the present invention to inject the foamable polyurethane mixture into a closed mold by other processes which are well known in the art. Typical processing equipment for this type of molding is commercially available (e.g., Model No. DSZ from DESMA-Werke, Achen, Republic of Germany).

The use of external or internal mold release agents all of which are well known in the art is preferably employed in the manufacture of the present invention. External mold release agents include silicones and/or waxes of various types. Internal mold release agents include specialty silicones and salts of fatty acids, for example, zinc stearate and the like.

Thus, while there have been described what are presently the preferred embodiments of the present invention, other and further changes and modifications could be made thereto without departing from the scope of this invention, and it is intended by the inventor herein to claim all such changes and modifications.

I claim:

1. A shock absorbing insole for high heel footware, comprising;

(a) an open cell, microcellular, flexible polyurethane foam footbed having a low compression set which extends from the heel portion to the metatarsal portion of the high heel footware;

(b) an energy-absorbing viscoelastic polymer component at the heel portion of the footbed; and (c) an energy-absorbing viscoelastic polymer component at the metatarsal component of the footbed.

2. The shock absorbing insole of claim 1, wherein said energy-absorbing viscoelastic polymer component at the heel portion of the footbed further includes a wide base which narrows towards a heel stem, thereby following the shape of a high heel shoe.

3. The shock absorbing insole of claim 3, wherein said energy absorbing viscoelastic polymer component at heel portion further includes voids for allowing said viscoelastic material to deform when a load is applied.

4. The shock absorbing insole of claim 4, wherein said viscoelastic polymer component at the heel portion of the footbed is substantially frusto-conically shaped, wider at the base and tapering towards the heel stem.

5. The shock absorbing insole of claim 1, wherein said energy absorbing viscoelastic heel portion includes a flat insert, whereby said insole is suitable for use with high heel footwear which was not designed with a deep receptacle for said heel portion of the insole.

6. The shock absorbing insole of claim 6, further comprising:

an energy absorbing viscoelastic polymer component at the metatarsal portion of the footbed.

7. The shock absorbing insole of claim 6, wherein said energy absorbing viscoelastic polymer component at heel portion further includes voids for allowing said viscoelastic material to deform when a load is applied.

8. The shock absorbing insole of claim 1, further comprising an upper wear resistant layer.

9. The shock absorbing insole of claim 9, wherein said upper layer includes a breathable, flexible wear resistant layer.

10. The shock absorbing insole of claim 10, further including a substantially continuous barrier layer between said wear resistant layer and said polyurethane foam footbed.

11. The shock absorbing insole of claim 11, wherein said footbed is formed and cured under over charging conditions, and said barrier layer substantially prevents or resists the penetration of the polyurethane into, through or beyond said upper layer.

* * * * *